US007034758B2

(12) United States Patent
Haidacher et al.

(10) Patent No.: US 7,034,758 B2
(45) Date of Patent: Apr. 25, 2006

(54) MULTIFUNCTIONAL ANTENNA

(75) Inventors: Florian Haidacher, Kolbermoor (DE); Siegfried Mathiae, Rosenheim (DE); Frank Mierke, München (DE); Marco Vothknecht, Stephanskirchen (DE); Peter Karl Prassmayer, Grosskarolinenfeld (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/527,663

(22) PCT Filed: Jun. 24, 2004

(86) PCT No.: PCT/EP2004/006863

§ 371 (c)(1),
(2), (4) Date: May 5, 2005

(87) PCT Pub. No.: WO2005/004280

PCT Pub. Date: Jan. 13, 2005

(65) Prior Publication Data

US 2005/0219131 A1 Oct. 6, 2005

(30) Foreign Application Priority Data

Jul. 3, 2003 (DE) ..... 103 30 087

(51) Int. Cl.
*H01Q 21/00* (2006.01)

(52) U.S. Cl. ..... 343/725; 343/700 MS; 343/844

(58) Field of Classification Search ..... 343/700 MS, 343/725, 844
See application file for complete search history.

(56) References Cited

U.S. PATENT DOCUMENTS

| | | | | |
|---|---|---|---|---|
| 6,441,792 | B1 | 8/2002 | Sievenpiper et al. | 343/713 |
| 6,538,611 | B1 * | 3/2003 | Noro | 343/725 |
| 6,646,614 | B1 * | 11/2003 | Killen | 343/725 |
| 6,788,264 | B1 * | 9/2004 | Du | 343/725 |
| 6,859,181 | B1 * | 2/2005 | Colburn et al. | 343/725 |
| 6,906,669 | B1 * | 6/2005 | Sabet et al. | 343/700 MS |
| 6,909,400 | B1 * | 6/2005 | Vothknecht et al. | 343/700 MS |
| 2002/0175879 | A1 | 11/2002 | Sabet et al. | 343/895 |

FOREIGN PATENT DOCUMENTS

| | | |
|---|---|---|
| DE | 28 00 913 | 7/1978 |
| DE | 202 07 401 U1 | 9/2002 |
| DE | 202 10 312 U1 | 10/2002 |
| DE | 101 33 295 A1 | 1/2003 |

(Continued)

OTHER PUBLICATIONS

R. P. Kronberger et al., "Array Antenna Principle Applied to Modern Car Antennas for Mobile Communication", Jun. 21, 1998, pp. 2224-2227, XP010292169.

(Continued)

*Primary Examiner*—Tan Ho
(74) *Attorney, Agent, or Firm*—Nixon & Vanderhye P.C.

(57) ABSTRACT

An improved antenna array comprises at least four antennas. One antenna receives satellite signals, especially digital satellite signals. One antenna receives terrestrial signals, particularly terrestrially transmitted radio programs. One antenna is provided for the mobile radio sector. One antenna determines the geoposition. The at least four antennas are disposed in a given order such that antenna, antenna, antenna, and antenna are located one behind another from one end of the chassis.

9 Claims, 3 Drawing Sheets

FOREIGN PATENT DOCUMENTS

| | | | |
|---|---|---|---|
| DE | 101 44 399 | A1 | 4/2003 |
| DE | 103 04 911 | A1 | 8/2004 |
| EP | 1 100 148 | A1 | 5/2001 |
| EP | 1 363 352 | A1 | 11/2003 |
| WO | 01/80366 | A1 | 10/2001 |

OTHER PUBLICATIONS

F. Tiezzi et al., "Design of Multiband Multibeam Conformal Antennas for Multimedia Mobile Satellite Receivers", Jul. 10, 2003, , pp. 1-9, XP009037508.

* cited by examiner

MULTIFUNCTIONAL ANTENNA

This application is the U.S. national phase of international application PCT/EP2004/006863 filed 24 Jun. 2004 which designated the U.S. and claims priority of DE 103 30 087.2, filed 3 Jul. 2003, the entire contents of each of which are hereby incorporated by reference.

The invention relates to a multifunctional antenna as claimed in the preamble of claim 1.

A satellite-based radio system which operates with only a small number of satellites distributed in orbit is used, in particular, in the USA. The aim is to offer antennas for this satellite-based radio system which have to maintain the same minimum gain even at low elevation angles from 20° and more, in particular from 25° up to an elevation of 90°.

The corresponding systems are also known in the specialist field by the expression SDARS services, which transmit in the 2.3 GHz band. The satellite signals are in this case transmitted with circular polarization.

In order to take account of these extreme conditions and to implement a high antenna gain even at low elevations from 20° or 25° and more, continuous attempts have been made to take account of these extreme requirements by specially designed antenna structures.

WO 01/80366 A1 has disclosed a special antenna system which contains cruciform dipole that is formed from a flat material and thus forms four quadrants which are separated from one another by the dipole walls. A separate, vertically extending monopole is then arranged in each quadrant, via which the terrestrially transmitted vertically polarized signals can be received. The aim is that program reception be possible by means of this second antenna arrangement whenever it is no longer possible to receive the programs emitted in parallel on satellite, because, for example, the satellite positioned in part very low on the horizon is shielded by mountains, buildings, tunnels etc.

In addition, for example, DE 202 07 401 U1 has disclosed a corresponding land vehicle receiving device for digital radio-frequency signals that are provided in a prescribed frequency band, firstly at low intensity by a satellite, and secondly at a substantially greater intensity by a terrestrial transmitter in shadow zones. Since the terrestrial signals are received with substantially greater intensity, this prior publication proposed a Wilkinson divider, which is also denoted as a 3 dB divider. Provided for this purpose in one downstream branch is a further, that is to say a second, amplifier, which once more amplifies the satellite signals of low intensity by a further stage in order to have received signals of approximately the same strength present at the output of the whole circuit. However, this prior publication covers neither a mobile radio antenna nor, for example, a GPS receiving antenna for geopositioning of the land vehicle.

DE 202 10 312 U1 has likewise disclosed an antenna arrangement for motor vehicles which is intended to be suitable, in particular, for receiving digital broadcast radio signals in accordance with the North American SDARS standard.

In addition, this antenna likewise comprises a rod-shaped mobile radio antenna as second antenna device. Moreover, with this antenna system there is no location system comparable to the GPS system for establishing the respective position of the land vehicle.

A vehicle antenna arrangement for receiving a number of different frequency bands separated by gaps has also been disclosed in DE 101 33 295 A1. This is an antenna arrangement with four antennas, specifically two broadband antennas for different mobile radio frequencies, a satellite-linked vehicle navigation antenna corresponding to the GPS system, and an antenna for the Satellite Digital Audio Reception System SDARS. It is further to be gathered in this case from the prior publication that the SDARS antenna is intended to have a configuration both for satellite-linked and for terrestrial operation with a vertical polarization.

By contrast, it is an object of the present invention to provide an antenna arrangement that, firstly, is suitable for receiving satellite signals, preferably even from satellites situated comparatively low above the horizon and, secondly, also is capable of receiving terrestrial signals, in particular terrestrially emitted radio programs, and which additionally also comprises at least one antenna for a mobile telephone as well as a receiving antenna for determining the coordinates, and thus the position, of a vehicle. The antenna is intended in this case to have the smallest possible installation space.

The object is achieved according to the invention in accordance with the features specified in claim 1. Advantageous refinements of the invention are specified in the subclaims.

It must be described as more than surprising that success has been achieved in implementing such an antenna according to the invention for receiving the most varied services in so compact a design. It is possible thereby for the antenna arrangement to be accommodated comparatively inconspicuously in compact form in a preferably fin-like housing on a land vehicle, that is to say a passenger car, for example, in particular in the roof area or at the transition from the roof area to the rear window.

The solution is all the more surprising since there was no indication in the prior art that this compact solution has become possible simply and solely through the inventive arrangement of the individual antennas for the various services.

Specifically, experiments have shown that it is necessary per se always to maintain certain minimum distances between the individual antennas for the various services in order to be able to implement a respectively adequate reception quality. Experiments have shown that, for example starting from an antenna device in accordance with WO 01/80366 A1, it would be necessary for an antenna device with the abovedescribed four services to be of extremely long construction. If, in the case of an antenna device in accordance with the abovementioned WO 01/80366 A1 a GPS antenna for determining position as well as a mobile radio antenna, for example, were to be arranged next to one another on a fin-like mounting plate in order to receive signals emitted via satellite as well as to receive terrestrial signals, this would lead to an arrangement with an overall length of much greater than 18 to 20 cm, as a rule.

By contrast, were it attempted to assemble comparable components more tightly in the longitudinal direction of a chassis, the result of this would be that the reception quality would not fulfill the required stipulations for the various services.

Against this background, the surprising result is to be seen in that despite an extremely compact arrangement overall with a high integration density, it has become possible simply and solely through the different sequence and arrangement of the individual antennas for the various services to construct an antenna arrangement for the various services that at the same time exhibits surprisingly good reception qualities.

The most varied experiments have shown that, for example, good reception qualities can be achieved for the various services with an antenna arrangement in which there should be provided on a chassis in a fashion running from the front tip to the rear end firstly a satellite receiving antenna, for example for SDARS services, subsequently a GPS antenna, then an antenna for terrestrial reception of signals, for example in the form of the terrestrially emitted SDARS services, and then a mobile radio antenna. However, this would then lead to an antenna structure with an overall chassis length of approximately 22 cm, and this would be judged far too large for fitting to the roof of conventional passenger cars.

By contrast, however, the invention proceeds from the idea that firstly a terrestrial receiving antenna (in particular for terrestrial reception of the SDARS services), subsequently an antenna for receiving the signals for determining the position of the motor vehicle (for example a GPS antenna), then a satellite antenna (for example for receiving SDARS services emitted via satellite) and, finally, a mobile radio antenna are preferably arranged on a chassis in the shape of a boat or fin in a fashion building up from front to rear (corresponding to the alignment on the motor vehicle), or in reverse sequence. It was possible owing to this sequence to attain an optimization which is such that the individual services could be received with the desired reception qualities, and that at the same time the antenna, that is to say the chassis, has a measure of length which can amount to under 18 cm, including under 17 cm without a problem. It has even emerged that the overall length of the chassis holding the antenna can be shortened to under 150 mm without a problem.

The antenna is explained more closely below with the aid of drawings in which, in detail:

Figure 1:
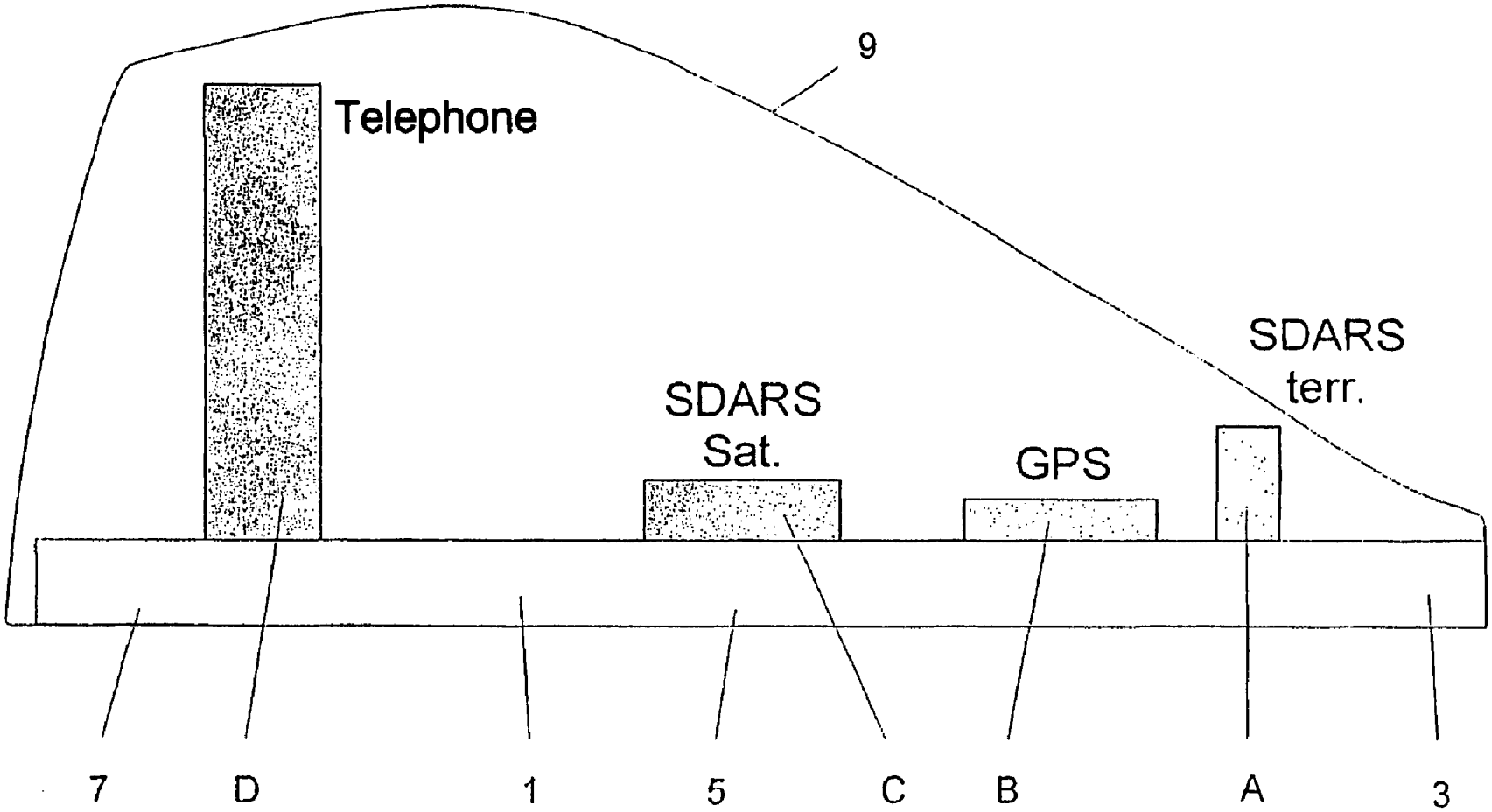
FIG. 1 shows a schematic side view of the antenna according to the invention.
Figure 2:
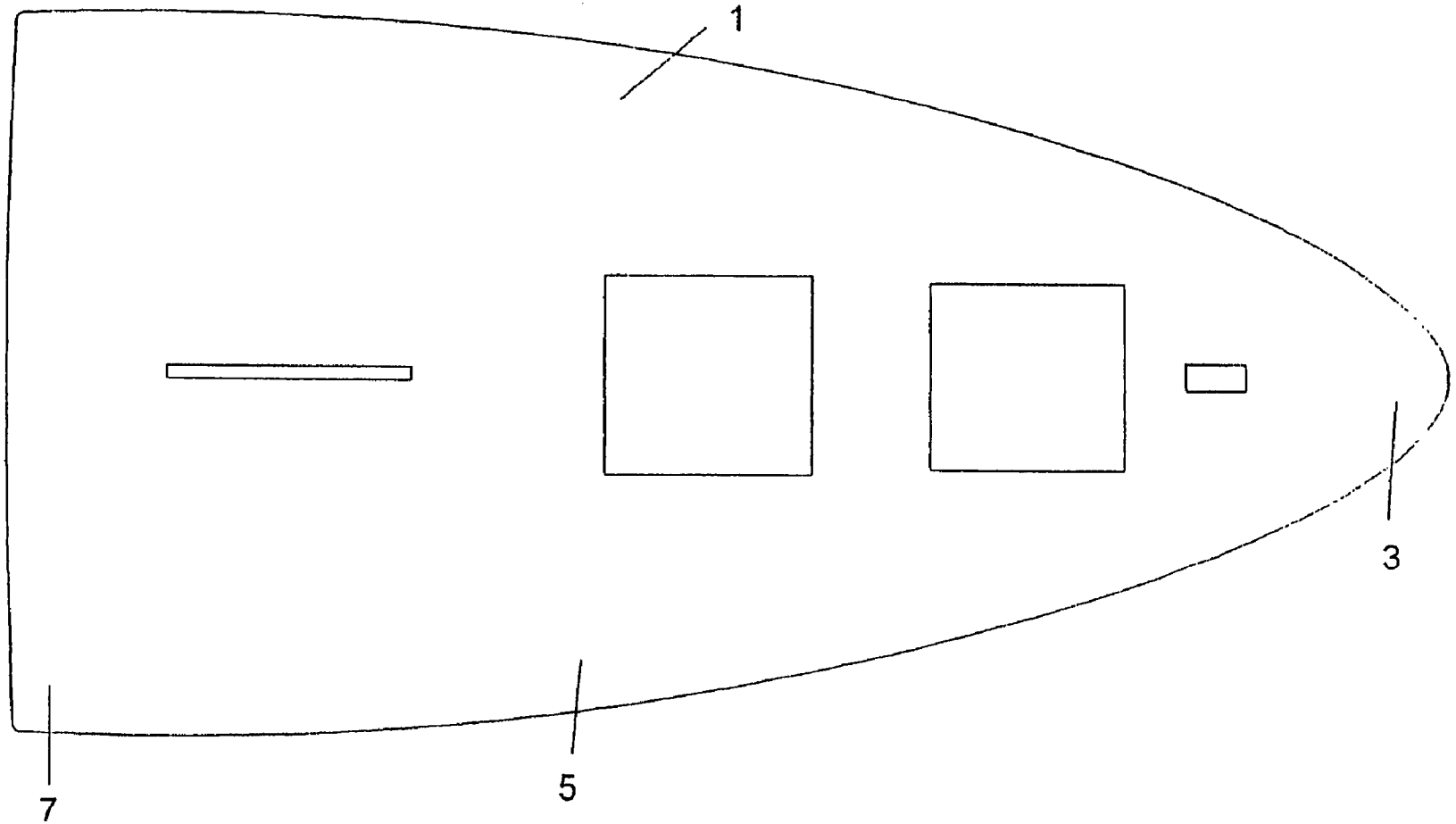
FIG. 2 shows a schematic plan view of the antenna reproduced in FIG. 1.

An exemplary embodiment of an antenna arrangement according to the invention is shown in schematic side view in FIG. 1, and in schematic plan view in FIG. 2.

The antenna arrangement comprises a chassis 1, which is shaped in plan view in a way comparable to a ship's hull, surfboard etc., specifically with a comparatively narrower, leading region 3, and a middle region 5, broader by comparison therewith, and a rear region 7. The chassis usually consists of a metallic basic body, for example a metal casting.

Figure 3:
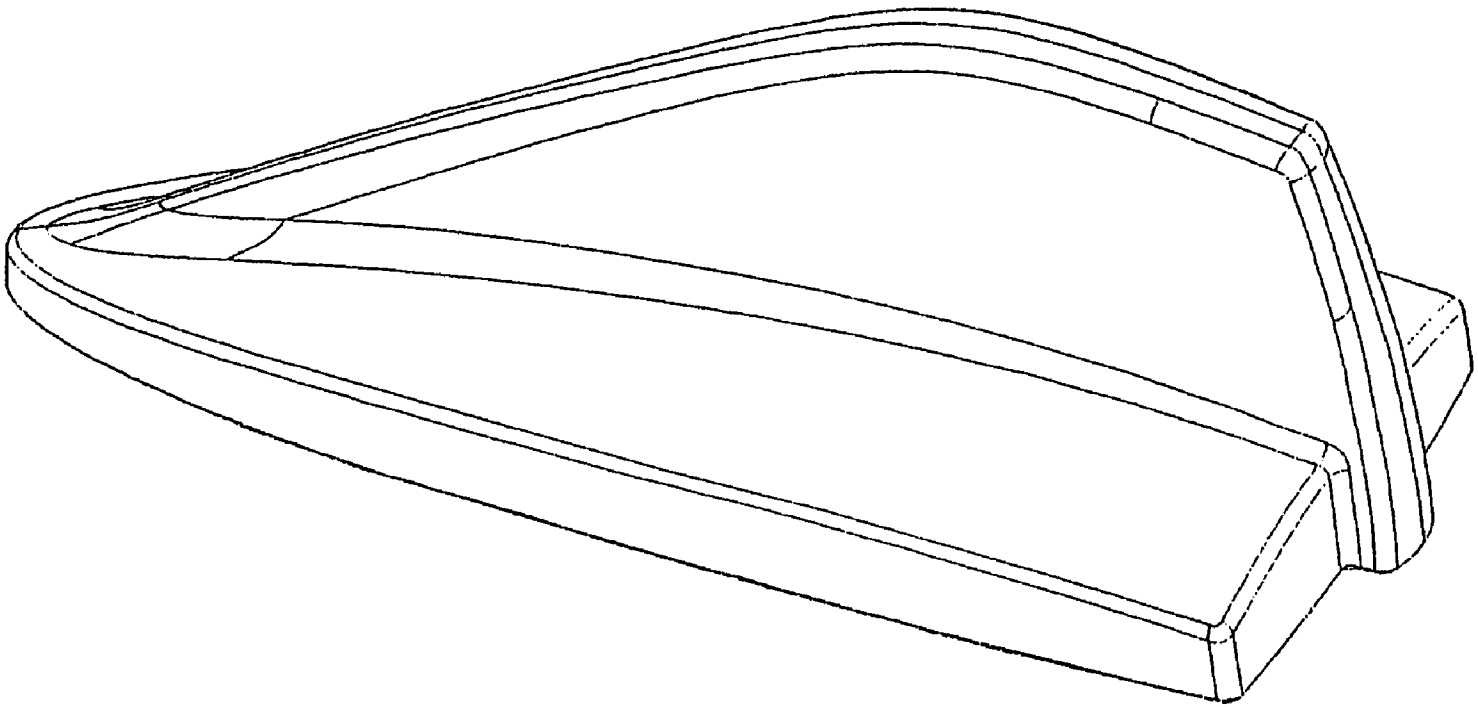
FIG. 3 shows a perspective illustration of the antenna arrangement with a housing cover protecting the individual antennas.

Such a chassis is usually mounted on a motor vehicle roof, for example at the rear end region before the transition to the rear window, either a cutout or a depression being provided in the body sheet at this point in the motor vehicle, in order to position the chassis 1 thus formed at a suitable height relative to the body sheet. Here, the leading, narrower region 3 points forwards with the motor vehicle in the driving direction, and so the rear region 7 comes to lie rearward on the vehicle. The corresponding antenna is usually mounted in the middle of the vehicle and is protected in this case via a housing cover 9 that preferably has a body in the shape of a fin, as is to be seen in the schematic rear view in accordance with FIG. 3.

In the exemplary embodiment shown, various antennas are accommodated in the chassis 1 below the housing cover 9, specifically, in a fashion following one another from the front region to the rear region 7:

firstly, an antenna A for receiving terrestrial signals;

subsequently, an antenna B for determining the position of the vehicle fitted with the antenna arrangement, for example an antenna B for the GPS location system;

subsequently, an antenna C for receiving satellite signals, in particular for receiving digital satellite signals, for example corresponding to the SDARS services in North America; and an antenna D for the mobile radio field.

The satellite antenna can be used, for example, to receive radio programs emitted by satellite. The antenna C can be designed in this case for receiving digital radio-frequency signals corresponding to the SDARS services in North America. These signals are emitted in this way in a frequency band of approximately 2.3 GHz.

However, the terrestrial receiving antenna A seated at the front can now receive terrestrially emitted signals, in particular terrestrially emitted radio programs. Particularly in the USA, such antennas are required for receiving the SDARS services, above all because the satellites emitting SDARS services are partly located not in their optimum position as vertically as possible over the receiving vehicle, but are positioned in part very low on the horizon down to an elevation angle of approximately 20° or, for example, approximately 25°. The consequence of this is that the signals emitted by satellites are frequently shielded, for example in gorges, tunnels, under bridges etc. In order to permit radio programs to be received even at such locations, terrestrially placed transmission positions are provided in part so that the radio programs can be received in parallel in these situations via the terrestrial antenna A.

The location system is preferably the GPS location system in worldwide use. However, other location systems such as, for example, the Galileo one currently being planned in Europe are also suitable for reception with such a receiving antenna.

A mobile radio antenna D is preferably proposed at the rear end. By virtue of the way it is fashioned, its size etc., this mobile radio antenna can be suitable for communicating in different mobile radio bands, for example for receiving in the 900 MHz band, in the 1.8 GHz band or, for example, in the 1700 to 2170 MHz band. Consequently, the mobile radio antenna can be suitable not only for receiving one of these frequency bands, but also for receiving two or three or in general a plurality of the frequency bands named, or other such bands. For this purpose, the mobile radio antenna can preferably comprise a substrate rising vertically in relation to the chassis 1, for example a printed circuit board on which appropriately conducting surfaces are formed as antenna elements.

The overall length of the chassis can amount to less than 170 nm, for example less than 160 mm or even 150 mm.

The invention claimed is:

1. A multifunction antenna comprising:

a chassis having a leading region and a trailing region, at least four antennas, at least one of said antennas being suitable for receiving digital satellite signals, at least one of said antennas provided for receiving terrestrially emitted radial programs, at least one of said antennas provided for a mobile radio field, and at least one of said antennas provided for determining geoposition, the antenna for receiving terrestrial signals being provided as a separate antenna in addition to the antenna for receiving satellite signals, the at least four antennas being arranged in a prescribed sequence on said chassis, the antenna for receiving the terrestrially emitted signals being arranged at one end of said chassis, followed by the antenna for determining the geoposition, followed by the antenna for receiving satellite signals, and followed by the antenna for the mobile radio field, the center-to-center distance between the terrestrial antenna and the adjacent antenna for geopositioning being smaller than the center-to-center distance between the geopositioning antenna and the adjacent antenna for receiving satellite signals, the center-to-center distance between the antenna for geopositioning and the adjacent satellite antenna being smaller than the center-to-center distance between the satellite antenna and the antenna for the mobile radio field, and the antenna for receiving the terrestrially emitted signals being arranged in the leading region of the chassis such that the mobile radio field antenna, seated furthest therefrom, is arranged in the trailing region on the chassis.

2. The multifunction antenna as claimed in claim 1, wherein at least three of said four adjacent antennas, are arranged adjacently on a longitudinal region of the chassis, which amounts to less than 60% of the overall length of the chassis.

3. The multifunction antenna as claimed in claim 1, wherein the antenna for receiving the satellite signals comprises a patch antenna.

4. The multifunction antenna as claimed in claim 1, wherein the antenna for carrying out geopositioning comprises a patch antenna.

5. The multifunction antenna as claimed in claim 1, wherein the antenna for receiving terrestrial signals comprises at least a monopole.

6. The multifunction antenna as claimed in claim 1, wherein the antenna for the mobile radio field is suitable for receiving at least in one mobile radio frequency band in at least two frequency bands.

7. The multifunction antenna as claimed in claim 6, wherein the antenna for the mobile radio field comprises electrically conducting surfaces that are formed on a substrate.

8. The multifunction antenna as claimed in claim 1, wherein the housing has a fin-like housing cover, and the four antennas are arranged on the chassis beneath said fin-like housing cover.

9. The multifunction antenna as claimed in claim 1, wherein in plan view the chassis is structured like a boat.

* * * * *